US009909220B2

(12) United States Patent
Whitmore

(10) Patent No.: US 9,909,220 B2
(45) Date of Patent: Mar. 6, 2018

(54) FASTENING SACRIFICIAL ANODES TO REINFORCING BARS IN CONCRETE FOR CATHODIC PROTECTION

(71) Applicant: Vector Corrosion Technologies Ltd., Winnipeg (CA)

(72) Inventor: David Whitmore, Winnipeg (CA)

(73) Assignee: Vector Corrosion Technologies Ltd., Winnipeg, MB (CA)

( * ) Notice: Subject to any disclaimer, the term of this patent is extended or adjusted under 35 U.S.C. 154(b) by 0 days.

(21) Appl. No.: 14/556,387

(22) Filed: Dec. 1, 2014

(65) Prior Publication Data

US 2016/0153096 A1 Jun. 2, 2016

(51) Int. Cl.

| | |
|---|---|
| ***C23F 13/02*** | (2006.01) |
| ***C23F 13/20*** | (2006.01) |
| ***C23F 13/18*** | (2006.01) |

(52) U.S. Cl.

CPC ..... *C23F 13/20* (2013.01); *C23F 13/18* (2013.01); *C23F 2201/02* (2013.01); *C23F 2213/22* (2013.01)

(58) Field of Classification Search

CPC ..... C23F 13/02; C23F 13/06; C23F 13/08; C23F 2213/30; C23F 13/10; C23F 13/16; C23F 13/18; C23F 2201/02; C23F 2213/20; C04B 2111/26; C04B 2111/265

See application file for complete search history.

(56) References Cited

U.S. PATENT DOCUMENTS

| | | | | |
|---|---|---|---|---|
| 6,165,346 | A | 12/2000 | Whitmore | |
| 6,193,857 | B1 * | 2/2001 | Davison | C23F 13/10 204/196.01 |
| 9,068,268 | B2 * | 6/2015 | Tarrant | C23F 13/10 |
| 2004/0238347 | A1 * | 12/2004 | Bennett | C23F 13/02 204/196.01 |
| 2007/0209949 | A1 * | 9/2007 | Whitmore | C23F 13/02 205/730 |
| 2008/0073223 | A1 * | 3/2008 | Glass | C23F 13/20 205/734 |
| 2015/0159282 | A1 * | 6/2015 | Goodwin | C23F 13/06 205/732 |

FOREIGN PATENT DOCUMENTS

| | | | | |
|---|---|---|---|---|
| EP | 1318247 | A1 * | 6/2003 | C23F 13/16 |
| WO | 9429496 | | 6/1994 | |

* cited by examiner

*Primary Examiner* — Luan V Van
*Assistant Examiner* — Alexander W Keeling
(74) *Attorney, Agent, or Firm* — Adrian D. Battison; Ade & Company Inc.; Ryan W. Dupuis

(57) ABSTRACT

In a method of corrosion protection of rebar in concrete the sacrificial anode is held in place by wrapping a first wire around a first rebar portion and a second wire at second rebar portion and twisting together the first and second free ends to tension the wrappings. This can be used either on two separate rebars which are parallel or at right angles or can be used at longitudinally spaced positions on a single rebar where the rebar roughening prevents the two wrappings from sliding as the wires are tensioned by the twisting. In many cases a covering material such as a porous mortar is cast onto the outer surface of the anode and in this case the mortar and the wire are located such that the wire exits from the sacrificial anode at a position separate from the layer of covering material.

20 Claims, 3 Drawing Sheets

FASTENING SACRIFICIAL ANODES TO REINFORCING BARS IN CONCRETE FOR CATHODIC PROTECTION

This invention relates to a method for fastening a sacrificial anode to one or more reinforcing bars in a covering material of concrete or mortar for cathodic protection of the metal in the covering material.

BACKGROUND OF THE INVENTION

Cathodic protection of steel in concrete using sacrificial anodes buried in the concrete and attached to the reinforcing bars is well known.

In PCT Published Application WO94/29496 of Aston Material Services Limited is provided a method for cathodically protecting reinforcing members in concrete using a sacrificial anode such as zinc or zinc alloy. In this published application and in the commercially available product arising from the application there is provided a puck-shaped anode body which has a coupling wire attached thereto. In the commercially available products manufactured in accordance with this disclosure there are in fact two such pairs of (four [4]) wires arranged diametrically opposed on the puck and extending outwardly therefrom as a flexible connection wire for attachment to an exposed steel reinforcement member. This arrangement is shown in U.S. Pat. No. 6,193,857 (Davison) issued Feb. 27, 2001 and assigned to Foseco International. A similar arrangement is also shown schematically in U.S. Pat. No. 6,165,346 (Whitmore) issued Dec. 26, 2000. The disclosures of the above cited documents are incorporated herein by reference.

SUMMARY OF THE INVENTION

It is one object of the present invention to provide a method of corrosion protection of one or more steel members in an ionically conductive concrete or mortar material where the attachment of the anode to the steel members in the concrete is improved.

According to the invention there is provided a method for corrosion protection of one or more steel members in an ionically conductive concrete or mortar material comprising:

locating a sacrificial anode comprising a sacrificial anode material which is less noble than the steel members in contact with the ionically conductive concrete or mortar material;

providing an electrically conductive connection between the sacrificial anode material and the steel section to form a circuit with communication of ions between the sacrificial anode material and the steel section through the ionically conductive concrete or mortar material so that the sacrificial anode acts to provide cathodic protection of the steel section;

wherein the electrically conductive connection is provided by a first and a second wire each extending from the sacrificial anode to a free end remote from the anode;

wrapping the first wire around a respective first portion of the one or more steel members so as to define a wrapping of the first wire of greater than 360 degrees around the portion with the free end of the first wire extending from the wrapping;

wrapping the second wire around a respective second portion of the one or more steel members so as to define a wrapping of the second wire of greater than 180 degrees around the portion with the free end of the second wire extending from the wrapping;

and twisting together the first and second free ends.

As used herein, the term cathodic protection provides a method which acts to mitigate or reduce or minimize corrosion of the steel section in the concrete.

In some arrangements the wrapping can extend over an angle greater than 360 degrees such as 540 degrees for example, or as much as 630 degrees.

When attaching the anode to a single bar, the wrapping of the two wires is preferably in opposite directions so the anode does not come loose by unwinding after wrapping and twisting. In this case it may not be necessary for the second of the wires to go around more than 360 degrees and this may be as little as 180 degrees. Thus for example if the two wires extend along the body of the anode to be twisted together at a central location, it may be natural and sufficient for the second of the wires to wrap around about 270 degrees and then along the bar and anode to connect to the first wire. The first wire would wrap a little more than 360 degrees to come together. Therefore the total wrapping of both wires generally will be a minimum of 720 degrees.

Preferably, the first wire and the second wire are wrapped in opposite directions when the wrappings are around two portions of a common steel member or rebar.

Preferably the twisting of the first and second free ends causes tightening of the first and second wires between the wrappings.

Preferably the twisting of the first and second free ends causes tightening of the wrappings of the first and second wires so as to cause the first and second wires to be pulled more tightly into engagement with the respective portion. That is the twisting of the first and second ends causes the wires to tighten on themselves to form a highly effective joint therebetween and also to tighten onto the steel members in the concrete to ensure a more effective and robust electrical connection and to provide more security of the connection.

As an alternative to tightly twisting the free ends to provide the final tightening action or in order to provide additional tightening action after the free ends are twisted, the anode body can be twisted by rotating the anode body. This arrangement is operable in an embodiment where both wires come out of the anode adjacent to each other such that they create a tightening action in the form of a helix or spiral when the anode body is twisted. This is particularly suitable with small anodes such that they could be attached and held in place sufficiently by a pair of wires at one location.

Preferably the twisting of the first and second free ends is carried out by twisting the first and second wires into a common helical twist.

In one arrangement the first and second portions comprise portions of two separate steel members. On this arrangement the two separate steel members can be parallel or at right angles. In both cases the tightening of the wires causes the anode to be stretched between the steel members providing a secure fastening and an effective electrical connection.

In another arrangement, the first and second portions comprise portions of a single steel member and the portions are spaced longitudinally.

In this arrangement, the first and second free ends can extend around the anode and be twisted together so as to cause the anode to be pulled toward the rebar. Alternatively, the first and second free ends can be twisted together so as to extend along a side opposite to the anode.

In all cases the twisting of the first and second free ends causes tightening of the first and second wires between the wrappings and the wrappings are prevented from moving longitudinally along the steel member by engagement of the wrappings with radially and diagonally projecting elements (ridges) on the steel members which are used for engagement with the concrete.

Preferably the first and second wires are connected to the anode at positions thereon which are spaced apart. This can be at opposed positions.

However the wires can extend both from one end of the anode body or from a common position on the body and can be pulled in opposite directions in the wrapping process.

In one method of manufacture, the first and second wires form portions of a common wire extending through the anode where the anode has a core cast onto the common wire. However other methods of manufacture of the anode can be used.

Preferably at least one of the first and second wires is shaped to define a loop at each of the free ends thereof to assist in manually pulling and manipulating the wire.

Preferably the anode includes a porous or deformable material for absorbing corrosion products from the sacrificial anode. This can be formed as a porous or deformable covering matrix on an exterior of the anode core or the core itself may be porous.

Preferably the anode includes at least one activator at the sacrificial anode for ensuring continued corrosion of the anode. This activator can be contained in the porous matrix or in the core itself.

Typically the first and second wires are of the same gauge and formed of steel or other conductive material such as stainless steel, galvanized steel, copper or titanium. The gauge is typically 16 to 18 gauge which provides a wire which is stiff but manually bendable so that it can be moved to the required location at the steel rebars and can be manually wrapped and pulled together for tightening by twisting. Twisting may be performed manually or using a tool such as a dedicated wire twister or pliers.

According to a second aspect of the invention there is provided a method for corrosion protection of one or more steel members in an ionically conductive concrete or mortar material comprising:

locating a sacrificial anode comprising a material which is less noble than the steel members in contact with the ionically conductive concrete or mortar material;

providing an electrically conductive connection between the sacrificial anode and the steel section to form a circuit with the communication of electrons through the electrically conductive connection and with communication of ions between the sacrificial anode and the steel section through the ionically conductive concrete or mortar material so that the sacrificial anode acts to provide corrosion protection of the steel section;

wherein the electrically conductive connection is provided by at least one wire extending from the sacrificial anode to a free end remote from the anode;

applying onto at least part of an outer surface of the sacrificial anode a covering material;

and locating the covering material and said at least one wire such that said at least one wire exits from the sacrificial anode at a position separate from the layer of covering material.

Typically the covering material is porous matrix arranged for absorbing corrosion products of the anode.

Preferably the covering material contains an activator for ensuring continued corrosion of the anode.

The arrangement wherein the wire exits from the sacrificial anode at a position separate from the layer of covering material is particularly important when the covering material is a mortar which is cast in a wet form and subsequently sets. This is beneficial to prevent gassing during placement and setting of the covering material when it is cast or otherwise applied onto the sacrificial anode body during manufacture. Gassing is due to the creation of a zinc/steel galvanic cell between the core and the wire when the covering material, typically mortar, is wet and before it sets. The release of gases in the galvanic action so formed can be the cause of bubbles forming in the covering layer leading to defective anodes.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
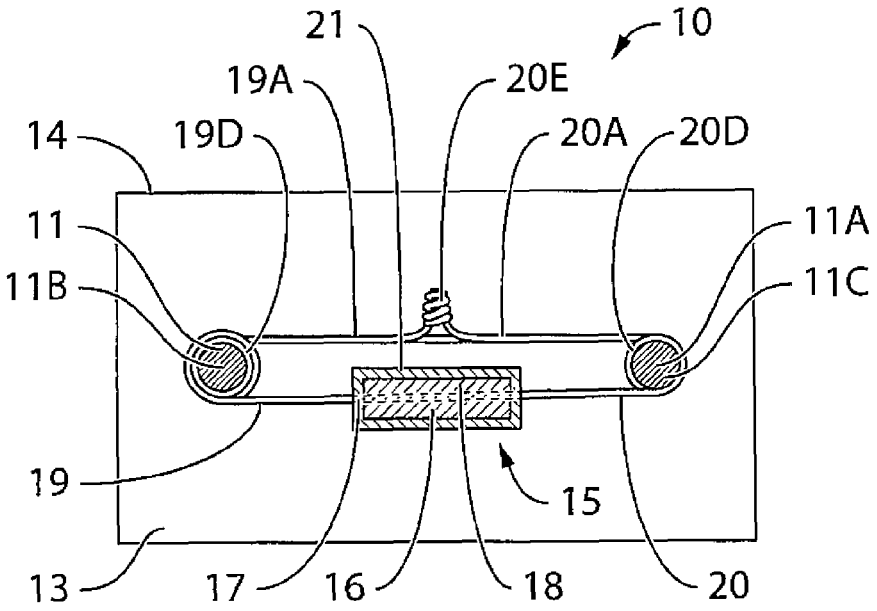
FIG. 1 is a cross-sectional view showing schematically a method according to the present invention for cathodic protection of steel members in concrete or mortar using an anode member having a sacrificial anode body attached by wires to the reinforcing steel members.

In FIG. 1 is shown a first embodiment according to the present invention of an improved cathodic protection device. The anode structure used is of a similar construction to that shown in the above application WO94/29496 and in U.S. Pat. Nos. 6,193,857 and 6,165,346.

Thus the cathodic protection device is arranged for use in a concrete structure generally indicated at 10 having reinforcing bars 11, 11A embedded within the concrete 13 and spaced from an upper surface 14 of the concrete.

Embedded within the concrete at a position adjacent to the reinforcing bar 11 is a cathodic protection device generally indicated at 15 which includes an anode body 16. The body 16 in the example as shown is rectangular in plan view to define an upper surface 18 and an edge surface 17 so as to be generally elongate rectangular shaped. Other shapes of the anode body can be provided including rectangular, square and elongated shapes and puck shaped. The anode is thus of any suitable convenient form in that it is typically relatively flat to allow insertion into the body of the concrete and it provides a sufficient volume of the anode material to avoid rapid depletion.

Two connecting wires 19 and 20, which are flexible but sufficiently stiff to be self-supporting, extend from the anode at diametrically opposed positions on the peripheral surface 17. Any suitable electrically conductive material such as steel, stainless steel, copper or titanium can be used. Wires may be bare, or may be fully or partially coated with electrically conductive material (plated or galvanized).

Figure 1A:
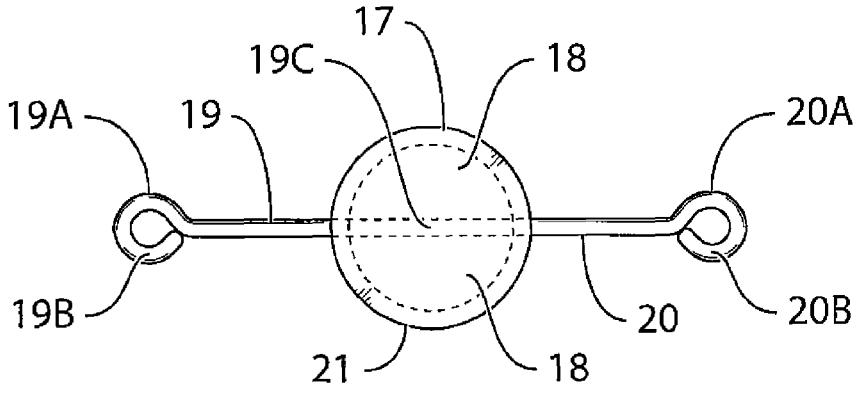
FIG. 1A is a top plan view of the anode member of FIG. 1 prior to attachment.

As shown in FIGS. 1 and 1A, around the anode body is provided a layer of a covering material 21 such as grout or mortar fully covering the periphery of the anode material. Thus the peripheral surface 17 of the anode body where the wires 19 and 20 emerge is covered by the layer 21 of the covering material. In practice the covering material is moulded around or is otherwise in contact with the sacrificial anode material. The thickness of the covering material is typically of the order of 1 cm. The wires 19 and 20 may pass through the covering layer. The covering layer is cast in place after the wires are attached to the anode material. The covering layer forms an electrolyte which is in intimate communication with the concrete layer so that a current can flow from the anode to the steel reinforcement 11.

Figure 2:
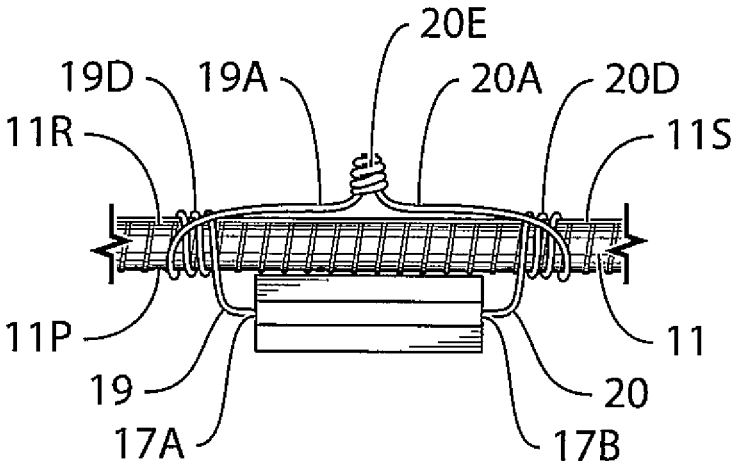
FIG. 2 shows an alternative coupling of the wires of the anode of FIG. 1 to a single reinforcing member.
Figure 3:
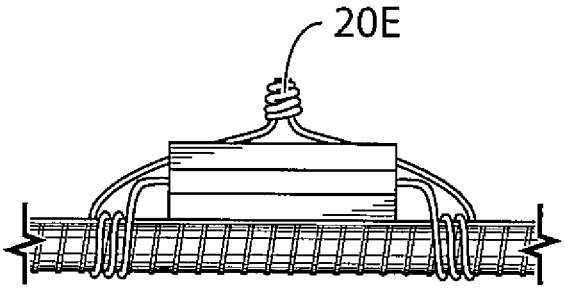
FIG. 3 shows a further alternative coupling of the wires of the anode of FIG. 1 to a single reinforcing member.

As an alternative shown in FIGS. 2 and 3, a configuration can be provided where the anode material extends to the periphery of the anode body at the ends 17A and 17B such that the wires exit from the sacrificial anode material at a position separate from the cast layer of covering material. That is the covering material is applied to the top and bottom surfaces of the anode body with the ends 17A and 17B of the sacrificial material exposed. Thus the steel wires 19 and 20 are not in contact with the covering material 21. This is beneficial to prevent gassing during placement and setting of the covering material when it is cast onto the sacrificial anode body during manufacture. Gassing is due to the creation of a zinc/steel galvanic cell between the core and the wire when the covering material, which is typically mortar containing one of more activators which typically have a high pH, is wet and before it sets. The release of gases in the galvanic action so formed can be the cause of bubbles in the covering layer and otherwise can cause defective anodes.

The covering material is preferably a solid so that it can contain and hold the anode without danger of being displaced during the process. However gels and pastes can also be used. The covering material preferably is relatively porous so that it can accommodate expansion due to formation of zinc corrosion products such as zinc oxide during consumption of the anode. However voids which might fill with water should be avoided.

The use of the protection device is substantially as described in the above application WO94/29496 in that it is buried in the concrete layer either during formation of the concrete in the original casting process or more preferably in a restoration process subsequent to the original casting. Thus sufficient of the original concrete is excavated to allow the reinforcing bar 11 to be exposed. The wires 19 and 20 are then wrapped around the reinforcing bar and the protective device placed into position in the exposed opening. The device is then covered by a cast portion of concrete or mortar and remains in place buried within the concrete or mortar.

This system is therefore only applicable to a sacrificial anode system where the anode is buried within the concrete. In an alternative arrangement, not shown, the anode can form a pad applied onto the surface of the concrete with the covering material applied to and covering only one surface for contacting the concrete.

The cathodic protection device therefore operates in the conventional manner in that electrolytic potential difference between the anode and the steel reinforcing member causes a current to flow therebetween sufficient to prevent or at least reduce corrosion of the steel reinforcing bar.

The anode and preferably the covering material 21 preferably includes at least one activator such as a high pH and/or a humectant and/or a halide, sulfate or nitrate material at the sacrificial anode for ensuring continued corrosion of the anode. Suitable materials are disclosed in the above cited documents.

The level of activator such as the pH and the presence of the humectant enhances the maintenance of the current so that the current can be maintained for an extended period of time preferably in a range 5 to 20 or more years.

The method thus includes locating the sacrificial anode 16 which is of a material which is less noble than the steel members 11 in contact with the ionically conductive concrete or mortar material and providing an electrically conductive connection 19, 20 between the sacrificial anode and the steel section to form a circuit with communication of ions between the sacrificial anode and the steel section through the ionically conductive concrete or mortar material so that the sacrificial anode acts to provide cathodic protection (corrosion protection) of the steel section.

The first and second wires 19, 20 each extend from the sacrificial anode 15 to a free end 19A, 20A remote from the anode. As shown in FIG. 1A, the first and second wires are shaped to define a loop 19B, 20B at each of the first and second free ends by turning back the end. However this is provided merely to assist in manual handling and tightening of the end and the ends can be simple terminations shown in FIG. 1.

Typically the first and second wires form portions of a common wire 19C extending through the anode material 16 which has a core of sacrificial anode material cast around or onto the common wire. This method of manufacture is very simple and provides an excellent connection both structurally and electrically between the wire and the sacrificial anode material.

As shown in FIG. 1, the first wire 19 is manually wrapped around a respective first portion 11B of the steel member or rebar 11 so as to define a wrapping 19D of the first wire 19 of greater than 360 degrees around the portion 11B. That is the wrapping extends more than one full turn so that it typically forms either one and a half turns or two and a half turns with the free end 19A of the first wire extending from the wrapping toward the second rebar 11A.

Symmetrically the second wire 20 is wrapped manually around the second portion 11C of the steel member 11A so as to define again a wrapping 20D of the second wire 20 of greater than 180 degrees around the portion with the free end 20A of the second wire extending from the wrapping back toward the rebar 11. The first and second free ends 19A and 20A are twisted together somewhere between the rebars 11 and 11A. The second wire can be wrapped with more than one full turn of 360 degrees or more but in some arrangements the second wire could wrap as little as 270 degrees if it is coming around to connect to the first wire along the side of the anode.

If 1.5 turns is used, the wrap goes around and back toward the anode if the anode is installed such that the anode wire is perpendicular to the reinforcing steel as shown in FIG. 1. However the number of turns could be a minimum of about 1.25 turns if the wire goes past the anode and then along the side of the anode as shown in FIG. 2. The number of turns could be a minimum of 1.0 turns if the goes around and then over the anode body as shown in FIG. 3.

That is the arrangement depends on the orientation of the anode relative to the reinforcing bars. In the case of FIG. 1, 1.5 turns will come back toward the anode such that the twist/tighten can be performed as illustrated. The same operation can be carried out in FIG. 4 in more or less the same manner.

FIGS. 2 and 3 show more than 360 degree wraps on both sides of the anode and this is probably the best way for installation to be carried out. However, if the twist tightening is along the side of the anode and not the back side opposite to the anode and the wires are wrapped in opposite directions, which is recommended and important to make sure they do not come loose later on, the wraps from the two wires will be different by +/−180 degrees.

If the first wire 1 wraps around 1.25 turns, the second wire can wrap around 0.75 or 1.75 turns to end up at the same radial position. The combination of 1.25 turns on the first wire and 1.75 turns on the second wire provides definitely a more secure connection. Construction workers may however do the minimum they think they can get away with and do 0.75 and 1.25 turns on the two wires. Although this is not ideal, 1.25 turns on one wire and 0.75 turns on the second wire in the case of an anode installed along a rebar may be sufficient.

This twisting can be done manually or by a pair of pliers or other dedicated twisting tool to form a helical twisted portion 20E where the two wires wrap around one another.

The twisting of the first and second free ends 19A and 20A at the twisted portion 20E acts to pull on the wires 19 and 20 between the rebars 11, 11A and causes tightening of the first and second wires between the wrappings. This pulling if continued sufficiently by the tightening action acts to cause tightening of the wrappings 19D and 20D of the first and second wires on the rebars 11 and 11A. This pulls the first and second wires more tightly into engagement with the respective rebar portion 11, 11A. This tightening increases the pressure of at least part of the wrapping onto the rebar depending on the number of turns and may wind the wrapping around the rebar so as to pull on the portion of the wires between the rebar and the anode so that the whole of the wires are tensioned.

Figure 4:
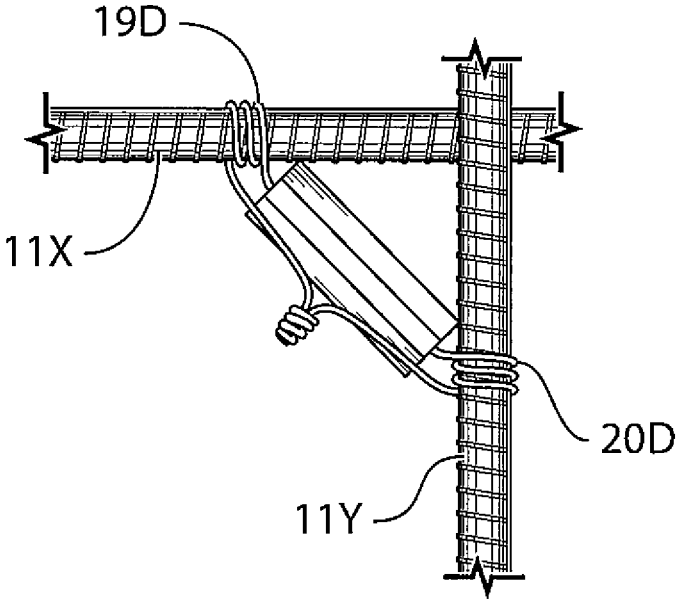
FIG. 4 shows an alternative coupling of the wires of the anode of FIG. 1 to two members at right angles.

In FIG. 1, the two separate steel members 11, 11A are parallel as it will be appreciated that this is a common arrangement in the reinforcement of the concrete structure. In FIG. 4 the two separate steel members are at right angles so the tensioning of the wires between the wrappings can cause some forces longitudinally along the two bars 11X and 11Y. The conventional roughness of the rebars prevents any such forces from causing sliding movement which could reduce the overall tension in the wires.

In FIG. 2, the first and second portions comprise portions 11R and 11S of a single steel member 11 so that the portions 11R and 118 and therefore the wrappings 19D and 20D are spaced longitudinally along the bar 11. Again the twisting of the first and second free ends causes tightening of the first and second wires 19, 20 between the wrappings 19D and 20D and the wrappings are tightened. The wrappings are prevented from moving longitudinally by inter-engagement of the wrappings with the conventional projecting elements 11P on the rebar 11. Preferably, the first wire and the second wire are wrapped in opposite directions when the wrappings 19D and 20D are around a common steel member or rebar. This prevents the installed anode from being dislodged or loosened as a result of construction activities prior to hardening of the new concrete.

As shown in FIG. 3, the first and second free ends are twisted together at 20E so as to extend also around the back of the anode so as to cause the anode to be additionally pulled toward and secured against the bar 11.

As shown in FIG. 2, the first and second free ends are twisted together so as to extend along the bar 11 on a side thereof adjacent to or opposite to the anode but arranged so as not to pull against the anode.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for corrosion protection of steel reinforcing in an ionically conductive concrete or mortar covering material comprising:

locating an anode construction in contact with the covering material;

providing an electrically conductive connection between the anode construction and a steel reinforcing bar of said steel reinforcing to form a circuit with the communication of electrons through the electrically conductive connection and with communication of ions between the anode construction and said steel reinforcing through the covering material so that the anode construction acts to provide corrosion protection of said steel reinforcing;

wherein the electrically conductive connection comprises a first and a second wire each extending from the anode construction to a free end remote from the anode construction;

wrapping the first wire around a first portion of said steel reinforcing bar so as to define a first wrapping of the first wire of greater than 360 degrees to form one or more turns of the first wire around the first portion with the free end of the first wire extending from the first wrapping;

wrapping the second wire around a second portion of said steel reinforcing bar so as to define a second wrapping of the second wire of greater than 180 degrees to form one or more turns of the second wire around the second portion with the free end of the second wire extending from the second wrapping;

said first portion of said steel reinforcing bar having a first end of the first portion at a first portion of contact of the first wire with the reinforcing bar and a second end of the first portion at a last point of contact of the first wire with the reinforcing bar, wherein the area between the first point of contact of the first wire and the last point of contact of the first wire is continuous;

said second portion of said steel reinforcing bar having a first end of the second portion at a first point of contact of the second wire with the reinforcing bar and a second end of the second portion at a last point of contact of the second wire with the reinforcing bar, wherein the area between the first point of contact of the second wire and the last point of contact of the second wire is continuous;

the first portion of the steel reinforcing bar including the first and second ends of the first portion being longitudinally spaced along the steel reinforcing bar from the second portion including the first and second ends of the second portion of the steel reinforcing bar so that the first wrapping is longitudinally spaced and separated from the second wrapping;

and forming a wire portion extending from the first wrapping at the first portion to the second wrapping at the second portion by twisting together the first and second free ends.

2. The method according to claim 1 wherein the twisting of the first and second free ends causes tightening of said wire portion.

3. The method according to claim 1 wherein the twisting of the first and second free ends causes tightening of said first and second wrappings.

4. The method according to claim 1 wherein the twisting of the first and second free ends is carried out by twisting the first and second wires into a common helical twist.

5. The method according to claim 1 wherein said first and second wrappings are prevented from moving longitudinally along said steel reinforcing bar by inter-engagement of the wrappings with projecting elements on said steel reinforcing bar.

6. The method according to claim 1 wherein said wire portion extends around a surface of the anode construction facing away from the steel reinforcing bar and pulls the anode construction toward said at steel reinforcing bar.

7. The method according to claim 1 wherein the first and second wires are connected to the anode construction at positions thereon which are spaced apart longitudinally of the steel reinforcing bar.

8. The method according to claim 1 wherein an outer surface of the anode construction includes a porous mortar covering layer which contains an activator for ensuring continued corrosion of a sacrificial anode material of the anode construction.

9. The method according to claim 8 wherein the first and second wires do not contact the covering layer.

10. The method according to claim 1 wherein an outer surface of the anode construction includes a porous mortar covering layer where the first and second wires do not contact the covering layer.

11. A method for corrosion protection of steel reinforcing in an ionically conductive concrete or mortar covering material comprising:

locating an anode construction in contact with the covering material;

providing an electrically conductive connection between the anode construction and a first steel reinforcing bar and a second steel reinforcing bar of said steel reinforcing to form a circuit with the communication of electrons through the electrically conductive connection and with communication of ions between the anode construction and said steel reinforcing through the covering material so that the anode construction acts to provide corrosion protection of said steel reinforcing;

wherein the electrically conductive connection comprises a first and a second wire each extending from the anode construction to a free end remote from the anode construction;

wrapping the first wire around said first steel reinforcing bar so as to define a first wrapping of the first wire around the first steel reinforcing bar with the free end of the first wire extending from the first wrapping;

wrapping the second wire around said second steel reinforcing bar so as to define a second wrapping of the second wire around the second steel reinforcing bar with the free end of the second wire extending from the second wrapping;

and forming a wire portion extending from the first wrapping at the first steel reinforcing bar to the second wrapping at the second steel reinforcing bar by connecting together the first and second free ends.

12. The method according to claim 11 wherein the twisting of the first and second free ends causes tightening of said wire portion.

13. The method according to claim 11 wherein the twisting of the first and second free ends causes tightening of said first and second wrappings.

14. The method according to claim 11 wherein the twisting of the first and second free ends is carried out by twisting the first and second wires into a common helical twist.

15. The method according to claim 11 wherein the first and second wires are connected to the anode construction at positions thereon which are spaced apart.

16. The method according to claim 11 wherein an outer surface of the anode construction includes a porous mortar covering layer and wherein the covering layer contains an activator for ensuring continued corrosion of a sacrificial anode material of the anode construction.

17. The method according to claim 16 wherein the first and second wires do not contact the covering layer.

18. The method according to claim 11 wherein an outer surface of the anode construction includes a porous mortar covering layer where the first and second wires do not contact the covering layer.

19. The method according to claim 11 wherein the first and second steel reinforcing bars are parallel.

20. The method according to claim 11 wherein the first and second steel reinforcing bars are at a right angle.

* * * * *